US006502526B1

(12) United States Patent
Aarsnes et al.

(10) Patent No.: US 6,502,526 B1
(45) Date of Patent: Jan. 7, 2003

(54) ANCHORING SYSTEM

(75) Inventors: Jan Aarsnes, Arendal; Fredrik Major, Kolbjørnsvik, both of (NO)

(73) Assignee: Advanced Production and Loading AS, Arendal (NO)

( * ) Notice: Subject to any disclaimer, the term of this patent is extended or adjusted under 35 U.S.C. 154(b) by 0 days.

(21) Appl. No.: 09/936,063

(22) PCT Filed: Mar. 3, 2000

(86) PCT No.: PCT/NO00/00078

§ 371 (c)(1),
(2), (4) Date: Dec. 17, 2001

(87) PCT Pub. No.: WO00/51881

PCT Pub. Date: Sep. 8, 2000

(30) Foreign Application Priority Data

Mar. 4, 1999 (NO) ..... 991062

(51) Int. Cl.[7] ..... B63B 21/50
(52) U.S. Cl. ..... 114/293; 441/5
(58) Field of Search ..... 114/293; 441/5

(56) References Cited

U.S. PATENT DOCUMENTS 5,061,131 A * 10/1991 Petty et al. ..... 114/264

FOREIGN PATENT DOCUMENTS

WO WO 97/30888 A1 * 8/1997

* cited by examiner

*Primary Examiner*—Jesus D. Sotelo
(74) *Attorney, Agent, or Firm*—Jenkens & Gilchrist P.C.

(57) ABSTRACT

A system for anchoring of a vessel in connection with the transfer of fluids, especially hydrocarbons, between the vessel (1) and a place at the seabed (4) wherein the system comprises a mooring line (5) extending between a connecting means (8) on the vessel (1) and an anchor means (6) at the seabed (4). A lump weight (9) is fastened to the mooring line (5) between the ends thereof, and a loading hose (12) extends between the anchor means (6) and a connecting point (15) at the vessel (1), the loading hose (12) at a place between the ends thereof being connected to the lump weight (9), so that the lump weight forms a point of division between a lower part (16) and an upper part (17) of the hose.

3 Claims, 1 Drawing Sheet

ANCHORING SYSTEM

Figure 1:
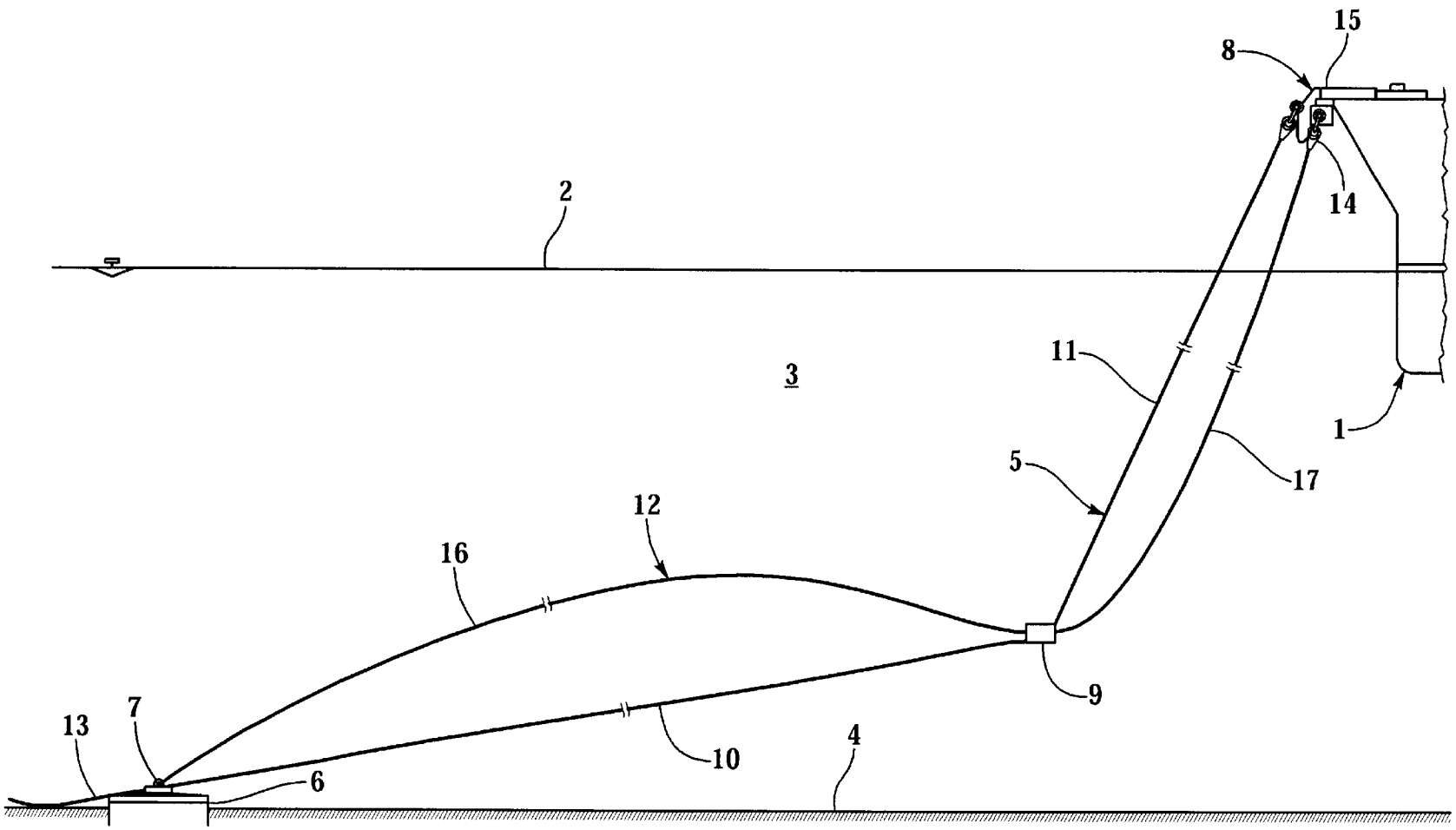

The invention relates to a system for anchoring of a vessel in connection with the transfer of fluids, especially hydrocarbons, between the vessel and a place at the seabed, wherein the system comprises. a mooring line extending between a connecting means on the vessel and an anchor means at the seabed.

In connection with offshore oil and gas activity it is often of interest to transfer hydrocarbon fluids between two vessels or between a pipeline at the seabed and an anchored vessel. Such operations often must be carried out under varying and difficult weather conditions, under the influence of strong wind, waves and water currents. This may involve very large stresses on the anchoring and loading/unloading equipment, something which may entail interruption in the operations or in the worst case may result in breakdown and uncontrolled oil discharge.

The object of the invention is to provide a system for anchoring and fluid transfer which implies an elasticity and flexibility in the anchorage which entails that the system will adapt itself to the occurring stresses and forces, so that the operations in questions may be carried out with greater safety and reliability in most situations.

The above-mentioned object is achieved with a system of the introductorily stated type which, according to the invention, is characterised in that a lump weight is fastened to the mooring line between the ends thereof, and that a loading hose extends between the anchor means and the connecting place at the vessel, the loading hose at a place between the ends thereof being connected to the lump weight, so that the lump weight forms a point of division between a lower part and an upper part of the hose.

The invention will be further described below in connection with an exemplary embodiment with reference to the drawing of which the only FIGURE shows a bow portion of a vessel which is anchored by means of the system according to the invention.

In the drawing there is shown a bow portion of a vessel 1, e.g. a tanker, floating on the surface 2 of a body of water 3 and being anchored to the seabed 4 by means of an anchoring or mooring line 5 and an anchor 6. At its lower end the mooring line is fastened to the anchor 6 via a swivel means 7 arranged on the anchor, and at its upper end the mooring line is fastened to a connecting or mooring means 8 of common design in the bow of the vessel 1.

The anchor means 6 is of a permanent type, preferably in the form of a suction anchor, or possibly a gravitation or pile anchor.

To the mooring line 5, at a place between the ends thereof, there is fastened a so-called lump weight 9 representing a point of division between a lower part 10 and an upper part 11 of the mooring line 5. The main purpose of the lump weight is to bring about a relatively concentrated tension in the mooring line, something which results in a compliant and flexible behaviour of the entire anchoring system, with reduced dynamic load effects. In other words, the lump weight gives a substantial contribution to the elasticity of the anchoring system.

A loading hose 12 extends between the anchor means 6 and the vessel 1, for fluid transfer between the vessel 1 and a pipeline 13 at the seabed, or vice versa. At its lower end the loading hose 12 is coupled to the pipeline 13 via the swivel means 7, and at its upper end the hose is equipped with a suitable connecting means in the form of an end piece 14 for connection to the manifold system of the ship 1. In the illustrated case, the hose is connected to the bow manifold 15, but it might instead be connected to another place of connection, e.g. a mid-ship manifold.

At a place between its ends the loading hose 12 is connected to the lump weight 9, so that the lump weight forms a point of division between a lower part 16 is and an upper part 17 of the hose. As shown in the drawing, the lower part 16 of the loading hose is located above a corresponding lower part 10 of the mooring line S, whereas the upper part 17 of the hose is located below the corresponding upper part 11 of the mooring line. This course of the loading hose may be achieved as a natural consequence of the buoyancy and weight characteristics of the hose, or it may be achieved or secured in that the hose is provided along the lower part with suitable buoyancy elements, whereas the upper part thereof possibly is provided with suitable weight elements.

In the drawing there is shown only one mooring line and one loading hose. If desired, however, the system may comprise more than one loading hose, and also more than one mooring line with appurtenant anchors.

As regards the lump weight 9, it is clear that this does not need to be placed in the middle of the mooring line. For achieving the desired elasticity action, however, it is an advantage that the lump weight is situated at a good distance from the lower end at the anchor 6 as well as from the upper end at the connecting means 8. The lengths of the upper and lower mooring line parts 10, 11 must, inter alia, be adapted to the water depth on the site.

The lump weight 9 is dimensioned so that, under the majority of conditions or stresses, it results in a rather considerable angle difference between the adjacent portions of the line parts 10 and 11. Thus, the line part 10 normally will be stretched upwards from the anchor 6 at a substantially smaller angle with the horizontal than the angle formed with the horizontal by the upper line part 1. By strong influence on the vessel 1 from wind, waves or ocean currents, the hole mooring line 5 will be able to be tightened more than what is shown in the drawing, so that the lump weight is raised in the water and the angle between the line parts 10 and 11 may approach more or less 180°. For the case that the lump weight 9 is lowered in the body of water, in that the anchored vessel 1 moves towards the anchor 6, the length of the upper mooring line part 11 is adapted such that the lump weight does not reach the seabed 4.

The present system is suitable for transfer of e.g. hydrocarbons from a pipeline at an ocean or sea bed to a ship, or vice versa. The system may also function as an anchorage for a ship during loading/unloading. The system is of the SPM type (Single Point Mooring), which allows the ship to turn about the anchoring point with weather and wind, so that it positions itself with the bow against the weather. This implies that the system, like other SPM systems, has the favourable property that the environmental forces (waves, wind, current) become far lower than for a fixedly anchored ship.

When the system is disconnected from the ship, the lump weight is laid down on the seabed. The upper end piece on the loading hose is also laid down on the bottom. In this manner the lump weight functions as an anchor for the loading hose and the mooring line when the system is laid down on the bottom.

The rotation of the swivel on the anchor is controlled by the horizontal tension in the mooring line. The lump weight entails that the line tension comes in approximately horizontally on the anchor, something which gives a very favourable torque as compared to a corresponding SPM system with a buoyancy buoy. This results in a substantially safer solution with respect to achieving rotation of the system.

Systems with a buoyancy buoy may incur considerable wave loads on the buoy. This especially applies to relatively shallow waters. The solution with a lump weight therefore will contribute to reducing the loads in the mooring line and the loading hose. For shallow water it will, for practical reasons, be difficult to use a buoyancy buoy. On the other hand, a system with a lump weight will also function in very shallow waters (down to a water depth of 10 meters, provided a sufficient water depth for the ship). The system has no components with buoyancy which might spring a leak during operation.

In disconnected condition of the system the lump weight will, as mentioned, function as an anchor for the loading hose and the mooring line. With this, the lump weight will keep the system approximately at rest at the seabed, even under extreme sea conditions. This is especially important in shallow waters, where large particle movements and velocities may be induced from the waves. For systems with a buoyancy buoy under corresponding conditions, the movement of the buoy will be able to result in large movements of the system at the seabed, with a risk for wear and damage. In disconnected condition of the present system, all the elements of the system are situated close to the bottom. This eliminates the risk for collision with passing ships.

What is claimed is:

1. A system for anchoring of a vessel in connection with the transfer of fluids, especially hydrocarbons, between the vessel and a place at the seabed, wherein the system comprises a mooring line extending between a connecting means on the vessel and an anchor means at the seabed, wherein a lump weight is fastened to the mooring line between the ends thereof, and that a loading hose extends between the anchor means and a connecting place at the vessel, the loading hose at a place between the ends thereof being connected to the lump weight, so that the lump weight forms a point of division between a lower part and an upper part of the hose.

2. A system according to claim 1, wherein the lower part of the loading hose is located above a corresponding lower part of the mooring line, and the upper part of the hose is located below a corresponding upper part of the mooring line.

3. A system according to claim 1 or 2, wherein the mooring line and the loading hose are connected to the anchor means via a swivel means on the anchor means.

* * * * *